US009289799B2

(12) United States Patent
Kleibl et al.

(10) Patent No.: US 9,289,799 B2
(45) Date of Patent: Mar. 22, 2016

(54) VIBRATION EXCITER FOR CONSTRUCTION MACHINES

(71) Applicant: ABI Anlagentechnik-Baumaschinen-Industriebedarf Maschinenfabrik und Vertriebsgesellschaft mbH, Niedernberg (DE)

(72) Inventors: Albrecht Kleibl, Grosshennersdorf (DE); Christian Heichel, Niedernberg (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 153 days.

(21) Appl. No.: 14/205,491

(22) Filed: Mar. 12, 2014

(65) Prior Publication Data

US 2014/0305236 A1 Oct. 16, 2014

(30) Foreign Application Priority Data

Apr. 10, 2013 (EP) ..... 13163223

(51) Int. Cl.

| | |
|---|---|
| ***B06B 1/16*** | (2006.01) |
| ***E02D 7/18*** | (2006.01) |
| *F15B 15/12* | (2006.01) |

(52) U.S. Cl.

CPC ..... *B06B 1/162* (2013.01); *B06B 1/161* (2013.01); *B06B 1/166* (2013.01); *E02D 7/18* (2013.01); *F15B 15/12* (2013.01); *Y10T 74/18344* (2015.01)

(58) Field of Classification Search

CPC ..... B06B 1/16; B06B 1/161; B06B 1/162; B06B 1/166; B06B 1/18; B06B 1/186; E02D 3/054; E02D 3/074; E02D 3/061; E02D 7/06; E02D 7/10; E02D 7/18; E21B 28/00; E21D 9/1046; F15B 15/12; G01V 1/02; G01V 1/143; G01V 1/153; Y10T 29/49245; Y10T 74/18344

USPC ..... 74/87, 61; 175/19, 408; 172/40; 404/117; 405/129.15, 271, 228; 418/3, 418/9, 164

See application file for complete search history.

(56) References Cited

U.S. PATENT DOCUMENTS 4,143,719 A * 3/1979 Furukawa ..... E02D 7/18 173/1
4,211,121 A * 7/1980 Brown ..... B06B 1/162 366/116

(Continued)

FOREIGN PATENT DOCUMENTS

AU 528 984 B2 5/1983
DE 41 18 069 A1 12/1992

(Continued)

*Primary Examiner* — William Kelleher
*Assistant Examiner* — Leonard J Archuleta
(74) *Attorney, Agent, or Firm* — Collard & Roe, P.C.

(57) ABSTRACT

A vibration exciter for construction machines, particularly for vibration pile drivers, includes at least one axle having at least two imbalance masses. At least one rotary piston pivot motor is provided, by way of which the rotational position of at least one imbalance mass, relative to the at least one other imbalance mass, can be changed. The rotary piston pivot motor has a pivot motor housing that is mounted on a pivot motor shaft so as to rotate relative to it. At least one rotary vane is disposed on the pivot motor shaft, the angle of rotation of which vane is limited by at least one stop disposed on the pivot motor housing. The maximal angle of rotation of the at least one rotary vane amounts to less than 160 degrees, preferably 150 degrees or less.

16 Claims, 6 Drawing Sheets

(56) References Cited

U.S. PATENT DOCUMENTS

| | | | | | |
|---|---|---|---|---|---|
| 4,784,047 | A * | 11/1988 | Stoll | F15B 15/12 | 277/345 |
| 5,177,386 | A * | 1/1993 | Shimada | B06B 1/166 | 310/81 |
| 6,161,650 | A * | 12/2000 | Ostergaard | F16H 57/0421 | 184/106 |
| 6,234,718 | B1 * | 5/2001 | Moffitt | A01B 11/00 | 172/40 |
| 6,345,546 | B1 | 2/2002 | Houze | | |
| 6,504,278 | B1 | 1/2003 | Bald et al. | | |
| 6,808,384 | B1 * | 10/2004 | Jordan | E04G 21/08 | 310/81 |
| 6,880,451 | B2 * | 4/2005 | Beilner | F01C 9/002 | 92/121 |
| 7,598,640 | B2 | 10/2009 | Heichel et al. | | |
| 7,866,253 | B2 * | 1/2011 | Bottger | F15B 15/12 | 188/290 |
| 8,070,352 | B2 * | 12/2011 | Heichel | E02D 3/054 | 173/49 |
| 8,522,891 | B2 | 9/2013 | Heichel et al. | | |
| 2010/0024578 | A1 * | 2/2010 | Jehanno | B06B 1/166 | 74/61 |
| 2010/0147090 | A1 * | 6/2010 | Kuerten | B06B 1/166 | 74/61 |
| 2013/0309115 | A1 * | 11/2013 | Thorwart | F15B 15/12 | 418/52 |
| 2014/0305234 | A1 * | 10/2014 | Kleibl | B06B 1/161 | 74/61 |
| 2014/0305235 | A1 * | 10/2014 | Kleibl | B06B 1/161 | 74/61 |
| 2014/0305236 | A1 * | 10/2014 | Kleibl | B06B 1/161 | 74/61 |

FOREIGN PATENT DOCUMENTS

| | | | |
|---|---|---|---|
| DE | 20 2007 005 283 | U1 | 7/2007 |
| DE | 10 2008 008 508 | A1 | 10/2008 |
| EP | 0 473 449 | A1 | 3/1992 |
| EP | 0 926 300 | A1 | 6/1999 |
| EP | 0 960 659 | A1 | 12/1999 |
| EP | 2 085 149 | A1 | 8/2009 |
| EP | 2 270 341 | A2 | 1/2011 |
| EP | 2 392 413 | A2 | 12/2011 |
| JP | S59-77145 | A | 5/1984 |
| WO | 99/58258 | A1 | 11/1999 |
| WO | 2007/068103 | A1 | 6/2007 |

* cited by examiner a)

b)

VIBRATION EXCITER FOR CONSTRUCTION MACHINES

CROSS REFERENCE TO RELATED APPLICATIONS

Applicant claims priority under 35 U.S.C. §119 of European Application No. 13163223.4 filed Apr. 10, 2013, the disclosure of which is incorporated by reference.

BACKGROUND OF THE INVENTION

1. Field of the Invention

The invention relates to a vibration exciter for construction machines, particularly for vibration pile drivers.

2. Description of the Related Art

In construction, vibration pile drivers are used to introduce materials to be pile-driven, such as profiles, for example, into the ground, or to draw them from the ground. The ground is excited using vibrations having a frequency above the natural frequency of the ground, and thereby achieves a "pseudo-fluid" state. The goods to be driven in can then be pressed into the construction ground using a static top load. The vibration is generated by means of rotating imbalances that run in opposite directions, in pairs.

The vibration exciters of such vibration pile drivers are vibration exciters that act in linear manner, the centrifugal force of which is generated by means of rotating imbalances. An essential characteristic of these vibration exciters is the static moment. This variable describes the installed imbalance. In vibration exciters configured as adjustable vibrators, the active variable of the imbalance is adjustable. In order to limit the roller bearing stress, adjustment of the static moment takes place by means of adjustment of the active imbalance of each shaft. In general, a center imbalance is rotated relative to two outer imbalances, in order to set the resulting imbalance in this manner. Because the inner imbalances of all the shafts are connected with one another by way of gear wheels, and the outer imbalances of all the shafts are connected with one another by way of gear wheels or by way of the shafts themselves, the relative angles between outer and inner imbalances are the same on all the shafts. A vibration exciter configured in this manner is disclosed, for example, in DE 20 2007 005 283 U1. In this connection, adjustment of the imbalance groups takes place by way of an additional shaft, which is configured as a phase shifter, in the present case in the form of a pivot motor. A particular construction is leader-mounted vibrators, which are usually equipped with three or four imbalance shafts. Such a leader-mounted vibrator is shown in EP 2 392 413 A2, for example.

The aforementioned vibration exciters fulfill the task set for them. It is desirable, however, to reduce the required adjustment pressure, to be able to do without slipping seals, and to improve the reaction time of the pivot motor provided for changing the static moment.

SUMMARY OF THE INVENTION

The invention wants to provide a remedy for these disadvantages. The invention is based on the task of making available a vibration exciter for construction machines, particularly for vibration pile drivers, in which the static moment is adjustable and the energy demand of which is reduced. According to the invention, this task is accomplished by a vibration exciter for construction machines, particularly for vibration pile drivers, including at least one axle having at least two imbalance masses. At least one rotary piston pivot motor is provided by way of which the rotational position of at least one imbalance mass, relative to the at least one other imbalance mass, can be changed. The rotary piston pivot motor has a pivot motor housing that is mounted on a pivot motor shaft so as to rotate relative to it. At least one rotary vane is disposed on the pivot motor shaft, the angle of rotation of which vane is limited by at least one stop disposed on the pivot motor housing.

The maximal angle of rotation of the at least one rotary vane amounts to less than 160 degrees, preferably 150 degrees or less. At least one imbalance mass is formed by the pivot motor housing of a pivot motor configured as a single-vane rotary piston pivot motor. The housing is configured in the shape of a circle sector and is disposed on the pivot motor shaft so as to rotate relative to it, which is an integral part of the at least one axle. At least one oil pocket to which oil can be applied is formed between the two stop surfaces of the stop, opposite the pivot space of the rotary vane of the pivot motor defined by the angle of rotation.

With the invention, a vibration exciter for construction machines, particularly for vibration pile drivers, is created, the static moment of which is adjustable, and the energy demand of which is reduced. Because the maximal angle of rotation of the at least one rotary vane, which is limited by at least one stop disposed on the pivot motor housing, amounts to less than 160 degrees, preferably 150 degrees or less, the reaction time of the pivot motor is increased—the pivot motor is adjusted more quickly. Furthermore, by means of the reduction in size of the chambers delimited between rotary vane and stop, in each instance, a reduction in the energy supply required for rotation of the pivot motor is brought about. It has been shown that the pivot angle provided in the state of the art, of 180 degrees, which allows placement of the imbalances opposite one another, thereby reducing the static moment to zero, is not absolutely necessary in practice. Furthermore, by means of the reduced pivot angle, it is possible to produce the pivot motor housing with a reduced construction, thereby making a reduction of its mass possible.

In an embodiment of the invention, at least one imbalance mass is formed by the pivot motor housing of a pivot motor configured as a single-vane rotary piston pivot motor. The housing is configured in the shape of a circle sector and is disposed on the pivot motor shaft so as to rotate relative to it, which is an integral part of the at least one axle. In this way, an imbalance shaft having an adjustable resulting imbalance is formed. At least one oil pocket to which oil can be applied is formed between the two stop surfaces of the stop, opposite the pivot space of the rotary vane of the pivot motor defined by the angle of rotation. By means of the at least one oil pocket, at least partial compensation of the resulting force acting on the bearings is achieved. The bearing load that results from the centrifugal force of the pivot bearing housing configured as an imbalance and from the oil pressure in the chambers is reduced by means of the at least one oil pocket. Oil pocket and sealing segment can be increased in size by means of a reduced angle of rotation.

In a further embodiment of the invention, at least one separate oil supply line is provided to supply oil to the at least one oil pocket in addition to the oil supply lines for the chambers disposed on both sides of the rotary vane.

In a further development of the invention, two rotary vanes that are disposed opposite one another are disposed on the pivot motor shaft of the at least one pivot motor. As a result, two pressure chambers that lie opposite one another in a direction of rotation, in each instance, are formed between the two rotary vanes and the related stop of the pivot motor housing. In this way, uniform bearing stress is brought about.

No additional bearing stress occurs as the result of the two pressure chambers disposed to lie opposite one another, in each instance, by means of the hydraulic oil introduced into the pressure chamber, in each instance. Likewise, the required oil pressure in the case of two vanes is lower, because in the case of two rotary vanes, the specific torque of the pivot motor doubles.

In an embodiment of the invention, no seals are provided to seal off the pivot motor housing with regard to the pivot motor shaft of the at least one pivot motor, whereby the sealing effect is brought about exclusively by way of the gap dimension. In this way, the maintenance effort is reduced, because no replacement of aged or worn seals, or seals that have become brittle due to overly high temperatures, is required. Instead, the sealing effect is achieved by means of narrow gaps. The risk of greater leakage is counteracted by means of operation at lower pressure, which is made possible by the lower pivot angle and preferably by means of the provision of two rotary vanes that lie opposite one another, which bring about a greater torque.

In another embodiment of the invention, the pivot motor shaft of at least one pivot motor is provided with an axial bore into which a fixed lance projects. This lance has at least two channels for supplying oil to the pivot motor, which channels open into a ring groove disposed on the outside of the lance, in each instance, whereby radial bores for connecting the at least two ring grooves of the lance with the chambers to be supplied are introduced into the pivot motor shaft. In this connection, the fit between lance and shaft bore in the region of the ring grooves is preferably structured as a tight slide bearing. The lance is preferably coated with plastic in this region. The provision of such a fixed lance counters the problem of the rotary feed-throughs usually used in the state of the art, which consist of a fixed housing that is flanged onto the housing of the vibration exciter, and a rotor that is mounted so as to rotate in this housing and is also driven by the rotating pivot motor. Bearings always demonstrate bearing play, and thereby all the components mounted in a vibrating housing rotate at a certain eccentricity. Although these eccentricities are relatively large in the case of self-mounted pivot motors, very tight plays are required in rotary feed-throughs, for reasons of sealing technology. A direct, rigid connection between the rotor and the rotary feed-through of the pivot motor shaft is not possible, because the heavy pivot motor would damage the sensitive bearings of the rotary feed-through. The lance, which is disposed in fixed manner, on the other hand, balances out the dancing movements of the pivot bearing shaft in the roller bearings, which demonstrate play as part of their function. This balancing is done, on the one hand, via the long shaft of the lance, which is preferably structured to be elastic, and is advantageously structured, via an attachment on the flange, in such a manner that the lance can absorb slightly slanted positions. In this connection, the lance is preferably mounted, on the end side, with play in a flange part attached to the housing of the vibration exciter, so as to prevent rotation.

In a further development of the invention, the lance has a head piece on the end side, which is increased in diameter, with which piece it is mounted in the flange part. In this way, resilient attachment of the lance in the flange is made possible. For this purpose, the gap between lance and flange part, formed by the play, is preferably bridged by at least one O-ring. The lance can be secured to prevent rotation, by means of an alignment pin that engages into the head piece.

It is advantageous if three imbalance masses are disposed on at least one axle. The center imbalance mass is formed by the pivot motor housing of a pivot motor structured as a single-vane rotary piston pivot motor. In this way, an imbalance shaft having an adjustable resulting imbalance is formed. Rotary piston pivot motors, also called rotary vane pivot motors, generate a torque directly, by means of one or more vanes disposed on the pivot motor shaft, to which vanes hydraulic oil is applied under pressure. When one vane is disposed on the pivot motor shaft, the rotary piston pivot motor is referred to as a single-vane motor. When two vanes are disposed on the pivot motor shaft, the rotary piston pivot motor is referred to as a two-vane motor.

In an embodiment of the invention, at least three axles provided with imbalance masses are disposed, which are connected with one another by way of gear wheels, whereby at least one imbalance mass of at least two axles, in each instance, is formed by a pivot motor housing of a pivot motor configured as an imbalance mass. In this way, a very compact construction is achieved. The entire static moment of the upper and the lower shaft corresponds to the static moment of the center shaft, in this connection. For this reason, the imbalances on the upper and the lower shaft do not take up the available construction space.

Preferably, the pivot motor housing of the at least one pivot motor is configured in the shape of a circle sector. In this way, a space-optimized imbalance is formed by the pivot motor housing.

In a further embodiment of the invention, at least one oil pocket to which oil can be applied is formed between the two stop surfaces, opposite the pivot space of the rotary vane defined by the pivot angle. In this way, at least partial compensation of the resulting force acting on the bearings is achieved. In the case of a configuration of the pivot motor housing as an imbalance, the bearings with which the pivot motor housing is mounted on the pivot motor shaft are increasingly stressed by the centrifugal force, with an increasing speed rotation. In addition, a bearing force results from the oil pressure in the chambers of the pivot motor. This bearing load, resulting from centrifugal force and oil pressure in the chambers, leads to an increased adjustment moment, which can be reduced by providing the at least one oil pocket.

To supply oil to the at least one oil pocket, it is advantageous if at least one separate oil supply line is provided in addition to the oil supply lines for the chambers disposed on both sides of the rotary vane. In this way, a hydraulic short-circuit between the two chambers of the pivot motor is excluded. Alternatively, two kick-back valves or also a shuttle valve can be provided. Valves are sensitive, however, to dynamic stresses, which are unavoidable in a vibrator transmission.

BRIEF DESCRIPTION OF THE DRAWINGS

Other further developments and embodiments of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
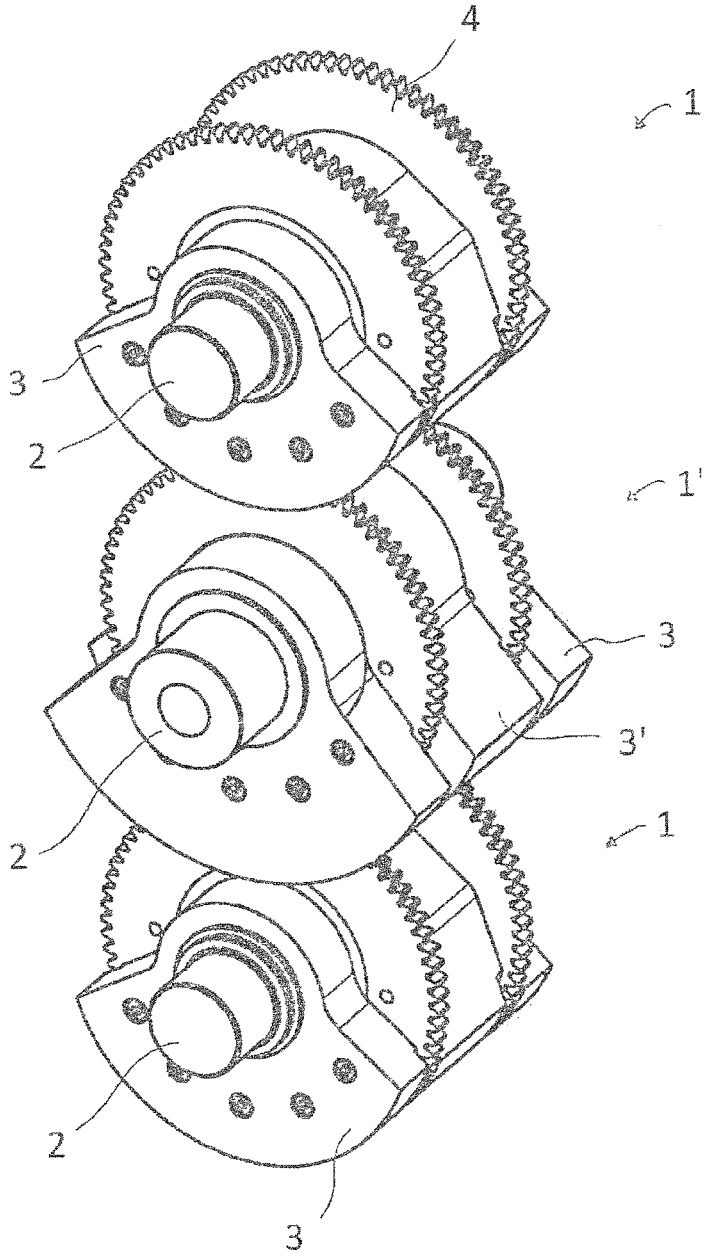
FIG. 1 is a schematic representation of a vibrator transmission with three imbalance shafts.
Figure 2:
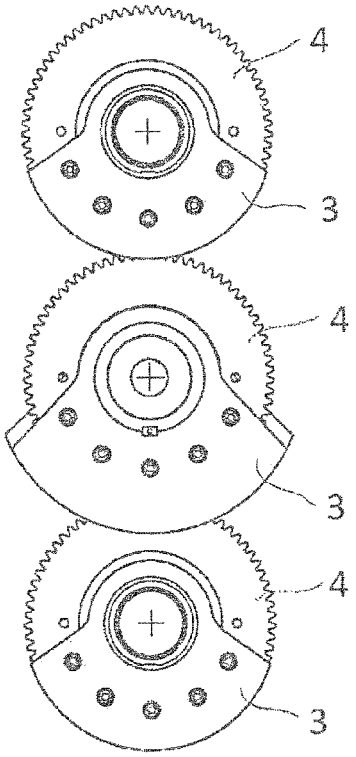
FIG. 2 is a representation of the vibrator transmission from FIG. 1 in a front view.
Figure 3:
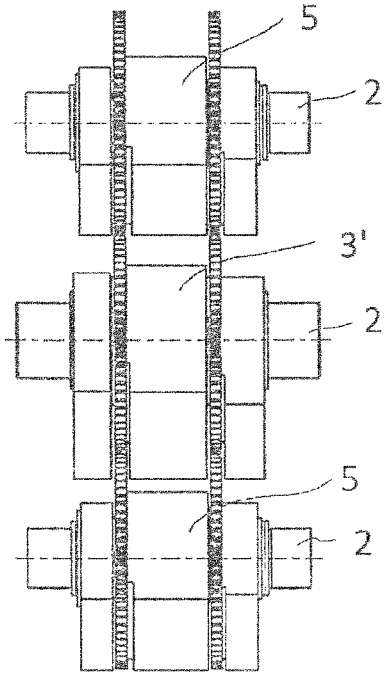
FIG. 3 is a representation of the vibrator transmission from FIG. 1 in a side view.
Figure 4:
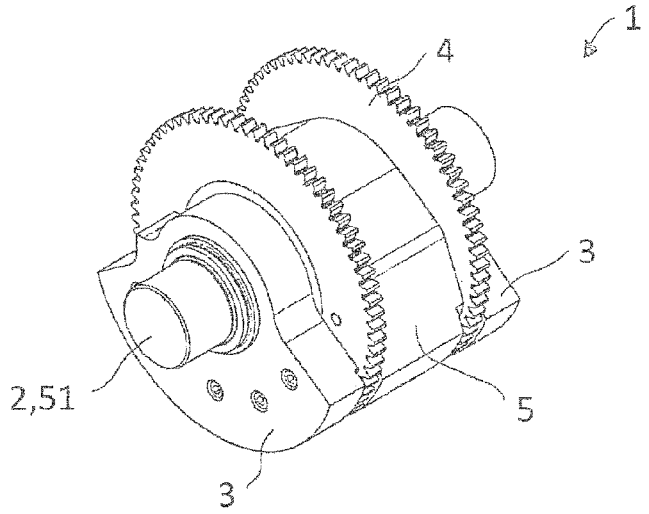
FIG. 4 is a representation of an upper imbalance shaft of the vibrator transmission from FIG. 1.
Figure 5:
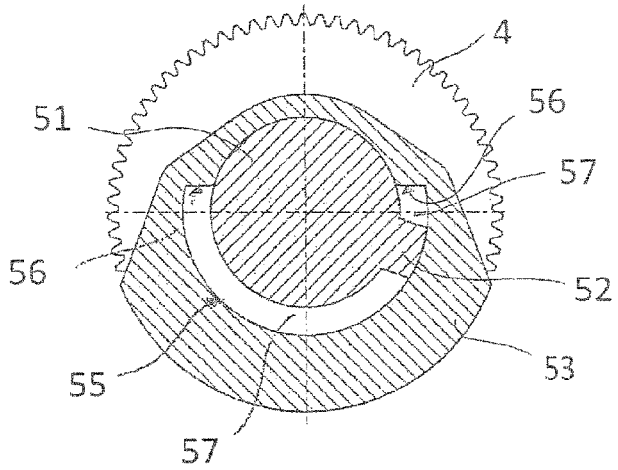
FIG. 5 is a representation of the imbalance shaft from FIG. 4 with a cross-section that runs through the pivot motor.
Figure 6:
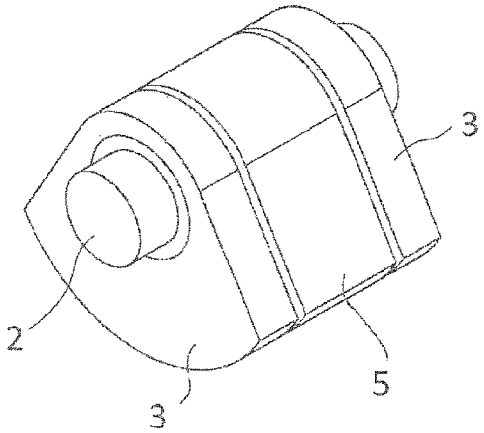
FIG. 6 is a schematic representation of the imbalance shaft from FIG. 5 a) at the maximal static moment.
Figure 6:
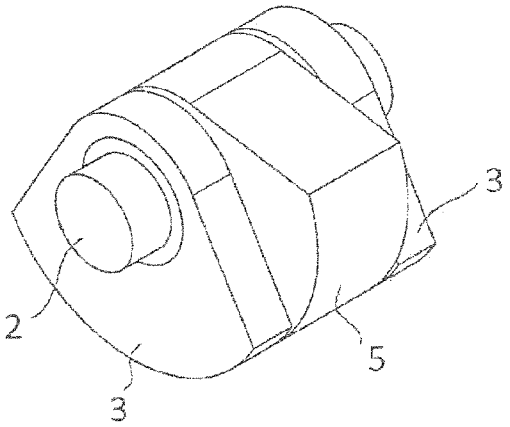
Figure 7:
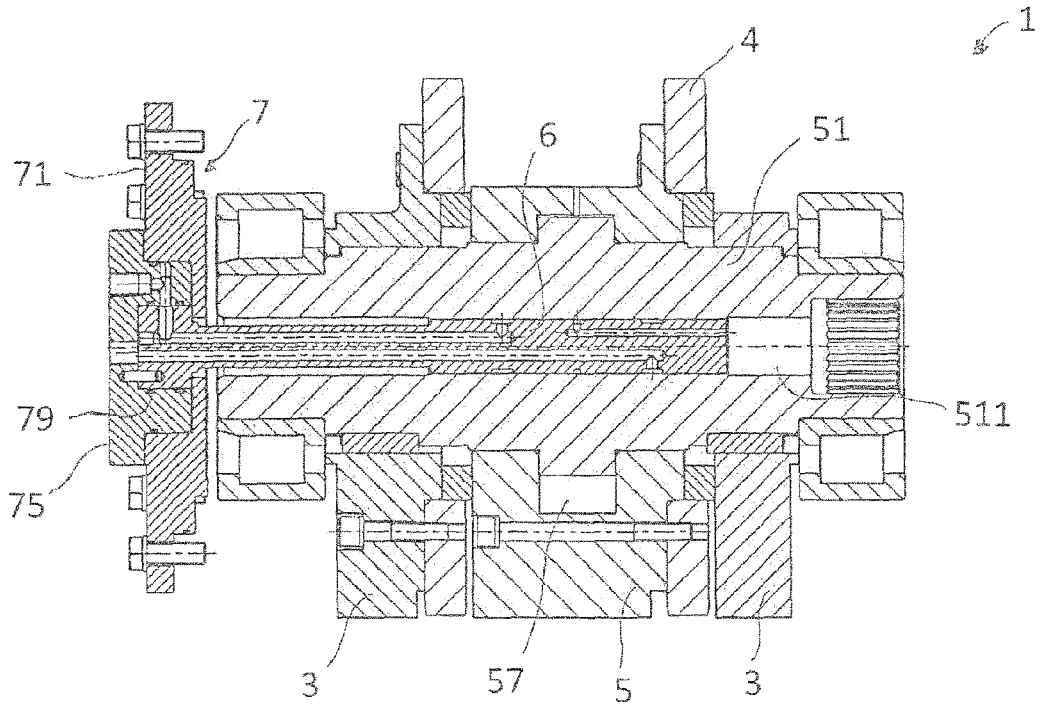
Figure 8:
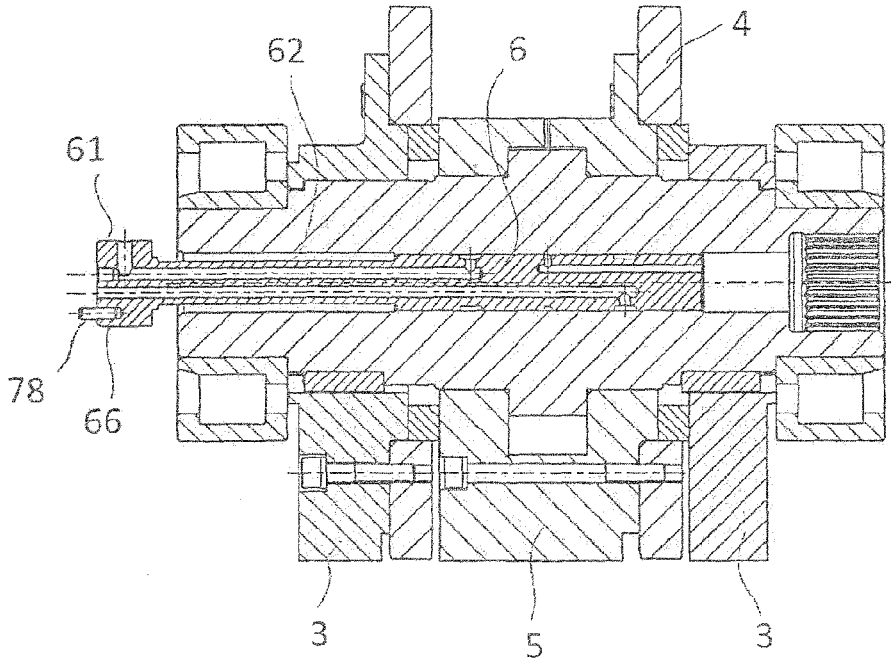
Figure 9:
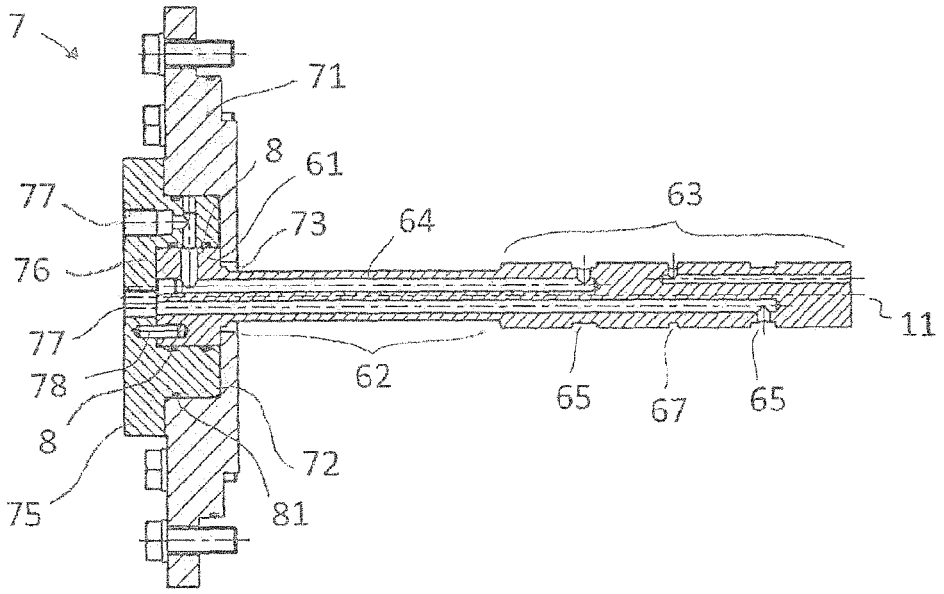
Figure 10:
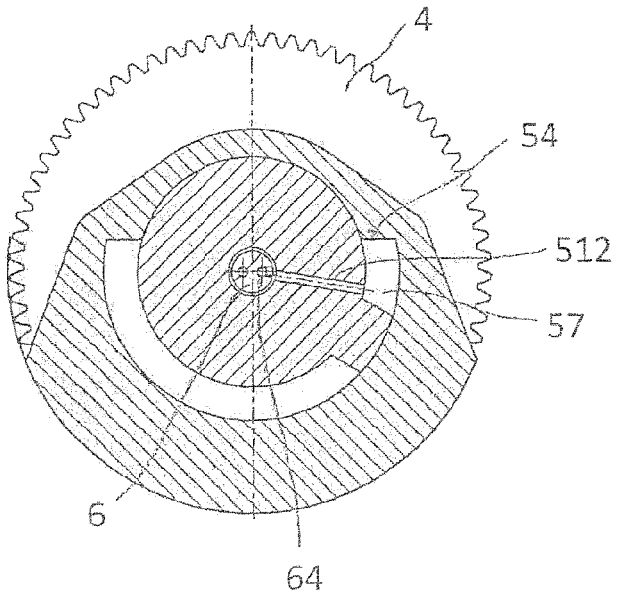
Figure 11:
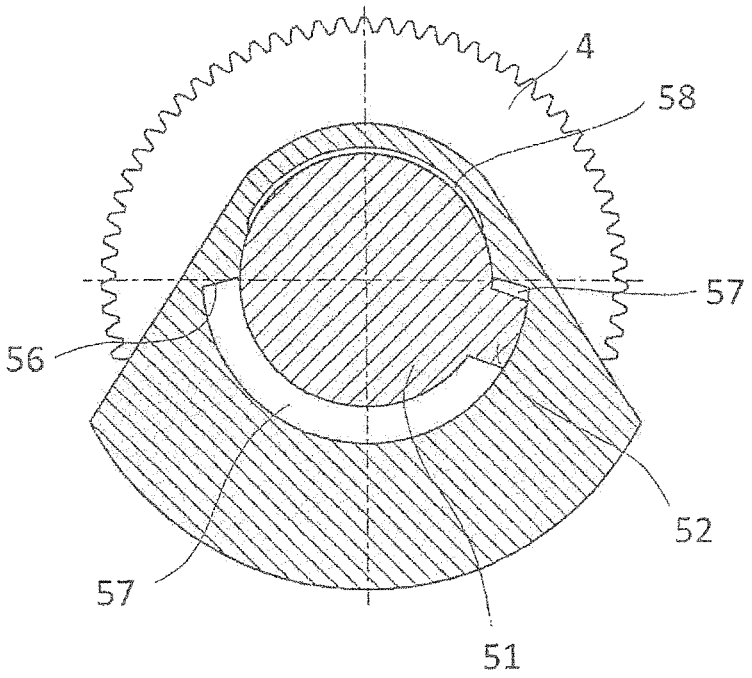

b) at a reduced static moment;

FIG. 7 is a schematic representation of the imbalance shaft from FIG. 4 in longitudinal section, with an introduced fixed lance for supplying oil;

FIG. 8 is a representation of the arrangement from FIG. 7 with the flange part removed;

FIG. 9 is a schematic representation of the lance of the arrangement from FIG. 7, with the flange part in place;

FIG. 10 is a schematic representation of the pivot motor of the imbalance shaft from FIG. 7 in cross-section, and FIG. 11 is a schematic representation of a pivot motor configured in accordance with the arrangement according to FIG. 10, in an embodiment with an oil pocket.

DETAILED DESCRIPTION OF PREFERRED EMBODIMENTS

The vibration exciter selected as an exemplary embodiment is structured as a three-shaft vibrator transmission. Three imbalance shafts 1, 1', 1 are provided, comprising an axis 2, on which two outer imbalance masses 3 are attached at a distance from one another. A gear wheel 4 is disposed on the axis 2 on the inner side disposed on the opposite outer imbalance mass 3, in each instance, adjacent to the outer imbalance masses 3, in each instance. At the outer imbalance shafts 1, a pivot motor 5 configured as a rotary piston pivot motor is disposed between the gear wheels 4. The pivot motor shaft 51 of this motor is an integral part of the axis 2. The center imbalance shaft 1' has an inner imbalance mass 3' on its axis 2, between the gear wheels 4. In this connection, the imbalance mass 3' is dimensioned to be twice as wide as the outer imbalance masses 3.

The imbalance masses 3, 3', 3 are configured to have the shape of a circle sector. In this connection, the radius of the outer imbalances 3 of the outer imbalance shafts 1 essentially corresponds to the radius of the gear wheels 4. The radius of the outer imbalance masses 3 and of the inner imbalance mass 3' of the center imbalance shaft 1' is clearly greater than the radius of the gear wheels 4 of the center imbalance shaft 1', which are dimensioned to be larger than the gear wheels 4 of the outer imbalance shaft 1, between which a rotary piston pivot motor 5 is disposed.

The rotary piston pivot motor 5 is formed by a pivot motor shaft 51, which is an integral part of the axis 2, as well as by a pivot motor housing 53 disposed on the pivot motor shaft 51. In the exemplary embodiment, the pivot motor shaft is provided with an axial bore 511 from which two radial bores 512 are passed to the outside, at a distance from one another. On the outside, a rotary vane 52 is formed onto the pivot motor shaft 51, which vane is disposed within the pivot space 55 formed by the inner contour 54 of the pivot motor housing 53.

The pivot motor housing 53 is configured as an imbalance in the shape of a circle sector, corresponding to the imbalance masses 3, 3'. The pivot space 55 formed between the inner contour 54 of the pivot motor housing 53 and the pivot motor shaft 51 is limited by two stop surfaces 56, which allow a maximal angle of rotation of 150 degrees. Two chambers 57 for operation of the rotary piston pivot motor 5 are configured between the stop surfaces 56 of the pivot motor housing 53 and the rotary vane 52 of the pivot motor shaft 51.

A lance 6 for supplying the chambers 57 of the rotary piston pivot motor 5 with hydraulic oil is introduced into the axial bore 511 of the pivot motor shaft 51. The lance 6 is configured essentially cylindrically. At the end side, the lance 6 has a head piece 61, followed by a shaft 62, which makes a transition into a slide bearing section 63 that is enlarged in diameter. Two channels 64 for supplying the chambers 57 of the rotary piston pivot motor 5 are introduced into the lance 6, coaxial to its center axis 11. The channels 64 open into a ring groove 65 disposed within the slide bearing section 63, in each instance, which is disposed so that one of the radial bores 512 of the pivot motor 5 is disposed orthogonal to this groove, which axial bore 511 represents the connection with the chamber 57, in each instance, of the rotary piston motor 5. Sealing of the ring grooves 65 relative to the pivot motor shaft 51 takes place by way of a very narrow gap between the slide bearing section 63 and the inner wall of the axial bore 511 of the pivot motor shaft 51, whereby the slide bearing section is provided with a slide bearing coating made of plastic, in the exemplary embodiment.

The lance 6 is mounted, with its head piece 61, on a flange part 7 that is attached to the housing—not shown—of the vibrator transmission. The flange part 7 essentially consists of a base plate 71 that is connected centrally with a recess 72, configured in pot shape. This recess 72 lies flush with a bore 73 passed through the base plate 71. The pot-shaped recess 72 accommodates the lid part 75, which is provided with a centrally disposed cylindrically configured recess 76, the outside diameter of which is slightly greater than the outside diameter of the head piece 61 of the lance 6. The lid part 75 is provided with supply connectors 77 for supplying the channels 64 of the lance 6 accommodated by the lid part 75.

Furthermore, an alignment pin 78 for engagement in an alignment bore 66 disposed eccentrically in the head piece of the lance 6 is disposed in the recess 76 of the lid part 75. Two ring grooves 79 for accommodating an O-ring 8, in each instance, are introduced circumferentially around the recess 76 of the lid part 75, parallel to one another. The O-ring 8 bridges the gap between the head piece 61 of the lance 6 and the recess 76 of the lid part 75, thereby causing the head piece 61 to be mounted in the lid part 75 so as to pivot slightly.

The lid part 75 is attached in the recess 72 of the base plate 71, and accommodates the head piece 61 of the lance 6, the shaft 62 of which projects through the bore 73 of the base plate, into the axial bore 511 of the pivot motor shaft 51 of the rotary piston pivot motor 5. In this connection, the lid part 75 is sealed relative to the pot-shaped recess 72, by means of an O-ring 81.

In the exemplary embodiment, the vibrator transmission is driven by two drives—not shown—that drive the uppermost and lowermost imbalance shaft 1, which is identical with the pivot motor shafts 51 of the rotary piston pivot motor 5 here.

The entire static moment of the upper and the lower imbalance shaft 1 corresponds to the static moment of the center imbalance shaft 1'; in the case of this three-shaft vibrator. For this reason, the imbalances 3 on the upper and lower imbalance shaft 1 do not take up the available construction space. A rotary piston pivot motor 5 is integrated into the upper and into the lower imbalance shaft 1, in each instance. This motor is situated in the center imbalance, in each instance. The pivot motor housing 53 of the rotary piston pivot motor 5 is configured as an imbalance mass in the shape of a circle segment, and is mounted on the imbalance shaft 1, in each instance, so as to rotate. The angle of rotation is limited to maximally 150 degrees via the rotary vane 52 formed onto the pivot motor shaft 51, in interaction with the stop surfaces 56 of the pivot space 55. The rotary vane 52 simultaneously serves as a seal between the two chambers 57 that are delimited between the rotary vane 52 and the pivot motor housing 53, as well as the pivot motor shaft 51. The two chambers 57 are supplied with hydraulic oil, which is fed in by way of the radial bores 512 of the pivot motor shaft 51. In order to feed the hydraulic oil to the rotating pivot motor shaft 51, the fixed lance 6 is mounted in the central, axially running bore 511. The sealing effect is achieved by means of tight gaps. In order to avoid excessive leakage, the hydraulic transmission is equipped with two pivot drives, thereby guaranteeing operation at low pressure, while simultaneously guaranteeing the required maximal torque of the pivot motors.

The hydraulic oil is fed to the channels 64 of the lance 6 by means of the supply connectors 77. From these channels 64, the oil gets into the ring grooves 65 on the outside of the lance. The chambers 57 of the rotary piston pivot motor 5 are closed off by means of radial bores 512, which connect the ring groove space, in each instance, with the corresponding chamber 57. Sealing of the ring grooves 65 relative to one another takes place by way of a narrow gap. In the exemplary embodiment, a leakage ring groove 67, which serves to conduct away any leakage oil that occurs, is disposed between the two ring grooves 65. The fit between the lance 6 and the axial bore 511 of the pivot motor shaft 51 is structured as a tight slide bearing in the region of the ring grooves 65, 67. In this region, the lance is provided with a slide bearing coating made of plastic, preferably polytetrafluoroethylene (commercially available under the trade name Teflon). A certain leakage exits through the slide bearing formed between the axial bore 511 of the pivot motor shaft 51 and the slide bearing section 63 of the lance 6, but this leakage simultaneously lubricates the bearing, separates the surfaces, and thereby counteracts friction wear.

Because the pivot motor housing 53 of the rotary vane pivot motor 5 is configured as an imbalance, in each instance, the bearings with which the pivot motor housing 53 is mounted on the pivot motor shaft 51 are increasingly stressed with centrifugal force at an increasing speed of rotation. In addition, a bearing force results from the oil pressure in the chambers 57. This bearing load, which results from centrifugal force and oil pressure in the chambers 57, leads to an increased adjustment moment. In order to at least partly compensate the resulting force that acts on the bearings, an oil pocket 58 can be additionally introduced into the pivot motor housing 53, to which pocket oil pressure can be applied (see FIG. 11). This oil pressure can be branched off, for example, when controlling the chambers 57. In this case, two kick-back valves or a shuttle valve are required to exclude a hydraulic short-circuit between the two chambers 57. Valves are sensitive, however, to dynamic stresses, which are unavoidable in a vibrator transmission. In order to avoid valves on the pivot motor and in order to be able to select the oil pressure in the oil pocket 58 independent of the adjustment pressure of the rotary vane pivot motor 5, it is possible to implement the oil supply in the oil pocket 58 by way of a separate connector. For example, the center connector formed by the leakage ring groove 67 can be used for this purpose.

Although only a few embodiments of the present invention have been shown and described, it is to be understood that many changes and modifications may be made thereunto without departing from the spirit and scope of the invention.

What is claimed is:

1. A vibration exciter for a construction machine comprising:

(a) at least one axle having at least first and second imbalance masses;

(b) at least one rotary piston pivot motor for changing of a rotational position of the first imbalance mass relative to the second imbalance mass, said rotary piston pivot motor comprising a pivot motor shaft integral with the at least one axle and a pivot motor housing mounted on the pivot motor shaft so as to rotate relative to the pivot motor shaft; and (c) at least one rotary vane disposed on the pivot motor shaft having an angle of rotation limited by at least one stop disposed on the pivot motor housing, said stop comprising first and second stop surfaces;

wherein the angle of rotation has a maximal angle value of less than 160 degrees;

wherein the pivot motor is configured as a single-vane rotary piston pivot motor and at least one of the first and second imbalance masses is formed by the pivot motor housing of the pivot motor, said pivot motor housing being configured in a shape of a circle sector and being disposed on the pivot motor shaft so as to rotate relative to the pivot motor shaft; and wherein at least one oil pocket for receiving oil is formed between the first and second stop surfaces of the stop opposite a pivot space of the rotary vane of the pivot motor defined by the angle of rotation.

2. The vibration exciter according to claim 1, wherein the maximal angle value is 150 degrees or less.

3. The vibration exciter according to claim 1, further comprising at least one separate oil supply line for supplying oil to the at least one oil pocket, in addition to oil supply lines for chambers disposed on first and second sides of the rotary vane.

4. The vibration exciter according to claim 1, wherein first and second rotary vanes are disposed opposite one another on the pivot motor shaft of the at least one pivot motor, so that first and second pressure chambers that lie opposite one another in a direction of rotation, in each instance, are formed between the first and second rotary vanes and an associated stop of the pivot motor housing.

5. The vibration exciter according to claim 1, wherein no seals are provided for sealing off the pivot motor housing with regard to the pivot motor shaft of the at least one pivot motor, and wherein a sealing effect is brought about exclusively by way of a gap dimension.

6. The vibration exciter according to claim 3, wherein the pivot motor shaft of at least one pivot motor is provided with an axial bore into which a fixed lance projects, wherein the lance has at least first and second channels for supplying oil to the pivot motor and opening into first and second ring grooves disposed on an outside portion of the lance, wherein the pivot motor shaft comprises radial bores for connecting the first and second ring grooves of the lance with the chambers of the pivot motor to be supplied.

7. The vibration exciter according to claim 6, wherein a fit between the lance and the axial bore of the pivot motor shaft is structured as a tight slide bearing near the ring grooves of the lance.

8. The vibration exciter according to claim 6, wherein the lance is provided with a plastic coating near the ring grooves.

9. The vibration exciter according to claim 8, wherein the plastic coating is formed from polytetrafluoroethylene.

10. The vibration exciter according to claim 6, wherein the lance has a shaft that is configured to be elastic.

11. The vibration exciter according to claim 10, wherein the lance has a reduced diameter near the shaft to bring about greater elasticity.

12. The vibration exciter according to claim 6, wherein no slipping seals are present over a length of the fit between the lance and the axial bore near the ring grooves of the lance.

13. The vibration exciter according to claim 12, wherein the lance has an end side mounted with play in a flange part attached to the housing of the vibration exciter so as to prevent rotation.

14. The vibration exciter according to claim 13, wherein the lance on the end side has a head piece having an increased diameter for mounting the lance in the flange part.

15. The vibration exciter according to claim 13, wherein the play forms a gap between the lance and the flange part and the gap is bridged by at least one O-ring.

16. The vibration exciter according to claim 13, further comprising at least one alignment pin that projects eccentrically and axially into the lance to prevent rotation.

* * * * *